US008820482B2

(12) United States Patent
De Coi et al.

(10) Patent No.: US 8,820,482 B2
(45) Date of Patent: Sep. 2, 2014

(54) ELEVATOR MONITOR AND DRIVE SAFETY APPARATUS

(71) Applicant: Cedes AG, Landquart (CH)

(72) Inventors: Beat De Coi, Sargans (CH); Tobias Leutenegger, Chur (CH); Dumeng Hersche, Bonaduz (CH); Jurg Hegelbach, Oberriet (CH)

(73) Assignee: Cedes AG, Landquart (CH)

( * ) Notice: Subject to any disclaimer, the term of this patent is extended or adjusted under 35 U.S.C. 154(b) by 76 days.

(21) Appl. No.: 13/677,678

(22) Filed: Nov. 15, 2012

(65) Prior Publication Data

US 2013/0146398 A1 Jun. 13, 2013

Related U.S. Application Data

(60) Provisional application No. 61/569,426, filed on Dec. 12, 2011.

(30) Foreign Application Priority Data

Dec. 12, 2011 (EP) ..... 11009794

(51) Int. Cl.

| | |
|---|---|
| ***B66B 1/28*** | (2006.01) |
| ***B66B 13/22*** | (2006.01) |
| ***B66B 5/00*** | (2006.01) |
| ***B66B 5/02*** | (2006.01) |

(52) U.S. Cl.

CPC ..... *B66B 5/0031* (2013.01); *B66B 13/22* (2013.01); *B66B 5/02* (2013.01)

USPC ..... 187/247; 187/391

(58) Field of Classification Search

CPC .... B66B 5/0018; B66B 5/0031; B66B 13/02; B66B 13/14; B66B 13/24

USPC ..... 187/247, 287, 289, 316, 317, 391–393

See application file for complete search history.

(56) References Cited

U.S. PATENT DOCUMENTS

| | | | | |
|---|---|---|---|---|
| 5,107,964 | A * | 4/1992 | Coste et al. | 187/280 |
| 6,173,814 | B1 * | 1/2001 | Herkel et al. | 187/288 |

(Continued)

FOREIGN PATENT DOCUMENTS

| | | | |
|---|---|---|---|
| EP | 0 905 901 | A1 | 3/1999 |
| GB | 876371 | A | 8/1961 |

OTHER PUBLICATIONS

European Search Report dated May 18, 2012.

*Primary Examiner* — Anthony Salata

(74) *Attorney, Agent, or Firm* — Burr & Brown, PLLC

(57) ABSTRACT

Safety apparatus for elevator apparatuses which can move a cab via a drive, wherein the drive can be monitored via a monitoring unit for monitoring the drive, including: a first safety circuit, which has a closed conduction state and an open conduction state, with an interruption apparatus for interrupting the drive depending on the conduction state of the first safety circuit, a safety device, which includes at least two sensors, which can be switched between at least two switching states depending on a state to be detected by the sensors. To provide improved maintenance, a switching unit is provided, which can be switched between at least two switching states by connection to the safety device and is designed to effect the closed and/or open conduction state of the first safety circuit, wherein the switching unit includes a transmission device for transmitting data and/or monitoring signals to the monitoring unit.

14 Claims, 8 Drawing Sheets

(56) References Cited

U.S. PATENT DOCUMENTS

| | | | | |
|---|---|---|---|---|
| 6,193,019 | B1 * | 2/2001 | Sirigu et al. | 187/391 |
| 6,467,585 | B1 * | 10/2002 | Gozzo et al. | 187/391 |
| 6,550,585 | B2 * | 4/2003 | Schoppa et al. | 187/391 |
| 7,252,180 | B2 * | 8/2007 | Deplazes et al. | 187/393 |
| 8,230,977 | B2 * | 7/2012 | Thumm et al. | 187/247 |
| 8,413,765 | B2 * | 4/2013 | Stratmann | 187/247 |
| 8,672,099 | B2 * | 3/2014 | De Coi et al. | 187/316 |
| 2010/0051391 | A1 | 3/2010 | Jahkonen | |
| 2011/0036668 | A1 | 2/2011 | Stratmann | |
| 2013/0025976 | A1 * | 1/2013 | Herkel et al. | 187/393 |
| 2013/0056309 | A1 * | 3/2013 | De Coi et al. | 187/316 |
| 2013/0146399 | A1 * | 6/2013 | De Coi et al. | 187/393 |

* cited by examiner

ELEVATOR MONITOR AND DRIVE SAFETY APPARATUS

CROSS REFERENCE TO RELATED APPLICATIONS

This application claims the benefit under 35 USC §119(e) of U.S. Provisional Application 61/569,426, filed Dec. 12, 2011, and claims the benefit under 35 USC §119(a)-(d) of European Application No. 11 009 794.6 filed Dec. 12, 2011, the entireties of which are incorporated herein by reference.

FIELD OF THE INVENTION

The invention relates to a safety apparatus for elevator apparatuses and an elevator apparatus.

BACKGROUND OF THE INVENTION

Conventional safety apparatuses for elevators which use electrical or electromechanical switches in order to determine the locking or closing state of an elevator door are known from the prior art. In this case, an elevator cab should only be permitted to travel when all of the doors are locked. If, for example, an elevator door is blocked and cannot be closed, the cab should also not be able to continue its journey. In order to achieve this, in conventional elevator apparatuses the corresponding electromechanical switch opens a contactor at the door, which contactor is connected into the drive circuit and therefore directly interrupts the drive by virtue of the power supply to the drive motor being interrupted by the contactor, for example.

SUMMARY OF THE INVENTION

The object of the invention consists in proposing a safety apparatus and elevator apparatus in which the susceptibility to maintenance can be improved and maintenance can additionally be simplified.

Correspondingly, a safety apparatus for elevator apparatuses which can move a cab via a drive, comprising: a first safety circuit, which has a closed and an open conduction state, with an interruption apparatus for interrupting the drive depending on the conduction state of the first safety circuit, and an additional safety device, which comprises at least two sensors, which can be switched between at least two switching states depending on a state, in particular a closing state, for example of the elevator door, is characterized by the fact that a switching unit is provided which can be switched between at least two switching states by connection to the safety device, wherein the switching unit comprises a transmission device for transmitting data and/or monitoring signals to the monitoring unit. In principle, measured values in the form of digital or analog data, identification codes of the sensors or of the controller, commands or the like can be transmitted. The transmission can also take place in the form of specific protocols.

In principle, the sensors could also be designed to detect a different state, for example, a maximum limit value for the motor temperature.

In addition, the switching unit is designed to effect the closed and/or open conduction state of the first safety circuit. The interruption apparatus serves to interrupt the drive, wherein the interruption is dependent on what the switching states of the switching unit and furthermore other switches in the first safety circuit are, i.e. whether actually all of the doors are locked. By virtue of this measure, the susceptibility to maintenance can be improved and the safety of the elevator increased correspondingly. Furthermore, the switching unit can transmit data and/or monitoring signals to the monitoring unit directly by connection to the said monitoring unit. This makes it possible for these data to be available directly to the monitoring unit and to be indicated, for example. In the case of maintenance, therefore, it can be indicated at or read off from the monitoring unit, for example the lift control system, directly where the safety circuit is blocked, where an elevator door is not closing or can no longer be locked, where a fault has occurred in the safety circuit/the safety device or whether all of the sensors are operating correctly. Decisive here is the interaction of the sensors which now, in contrast to electromechanical switches, no longer cause an interruption in a circuit with the measure that provides that signals can be transmitted to the monitoring unit or to the lift control system which can therefore be used directly. The safety device thus continues to be a structural unit which operates independently, but the monitoring unit/lift control system can be supplied with information constantly in respect of which operating state is present at that time or whether a fault or a blockage has occurred.

In particular, the monitoring unit/lift control system, which monitors the journey of the cab via the motor regulation system, can additionally adjust the motor regulation system, for example in the case of an interruption, in such a way that the cab can be started again smoothly once the interruption is over, for example, is switched over to an emergency operation program or the like. Overall, therefore, the maintenance can also be simplified since the safety device no longer needs to be inspected separately individually as a separate structural unit.

A lift control system or monitoring unit receives, inter alia, commands from the users, for example by depression of a pushbutton, when the cab is called by a user waiting in front of the lift or a story to be approached is selected. The lift control system/monitoring unit can also control the motor regulation of the drive motor during regular operation, however (smooth approach, braking, standby operation etc.).

If a plurality of doors are provided, the journey can only be begun or continued when all of the doors are locked. Correspondingly, it is expedient if the corresponding sensors which are each associated with a door, are connected in series.

The first safety circuit has, for example, normally-closed switches and a relay/contactor as interruption apparatus. The normally-closed switches can be in the form of electromechanical switches in the case of conventional safety circuits. If an open conduction state is effected, i.e. the first safety circuit is interrupted, the relay or the contactor also opens and interrupts a motor of the elevator, for example.

The safety device can to a certain extent be considered to be an equivalent circuit for individual normally-closed switches or for all of the normally-closed switches which monitor the closing state or locking state of the door. In principle, the safety device may also be a second safety circuit.

In one development of the invention the transmission device is in the form of a controller, which has a connection to the safety device, wherein the transmission device is designed to switch the switching unit. As a result, the controller takes on the function of the transmission of the data/monitoring signals to the monitoring unit and, in the case of an interruption, the controller switches the switching unit as well, with the result that said switching unit causes an interruption in the first safety circuit. This means that the drive is disconnected.

The transmission device can also be designed to receive data and/or monitoring signals of the monitoring unit, as a result of which data interchange is advantageously made possible. It is conceivable, for example, for the monitoring unit to request the present operational status via a command and then receive the response data relating to the operational status from the controller or for the monitoring unit to regularly run a check on the controller. This measure can also simplify the maintenance and improve the maintenance susceptibility.

It is also conceivable for the monitoring unit to receive a signal via another I/O interface (for example the emergency-stop switch in the cab), with the result that said monitoring unit transmits a command for interrupting the safety circuit to the switching unit of the safety device for safety reasons, although the sensors indicate regular operation (for example doors locked).

To a certain extent, this apparatus makes it possible for the safety circuit or the arrangement of sensors to be "decoupled" as a separate apparatus. This can be advantageous in particular when an apparatus with comparatively high voltages is required for the interruption apparatus. Such an apparatus presents corresponding disadvantages in terms of installation or maintenance since there is a possibility of touching contact being made with possibly live parts with a relatively high voltage; in the safety apparatus according to the invention, these disadvantages can be avoided. The safety circuit itself can in principle be operated at relatively low voltages, however.

In one embodiment of the invention, the safety device can correspondingly be in the form of a second safety circuit, which comprises at least two sensors, which can be switched between at least two switching states depending on a closing state, which is intended to be detected by the sensors. For example, the closing state or locking state of the elevator door can be determined by the sensors. However, the interruption apparatus can be designed to interrupt and/or continue the drive depending on the switching state of a switching unit (not of the sensor directly). The switching unit in turn can be switched between at least two switching states by connection to the safety circuit. Thus, the interruption apparatus and the switching of the interruption apparatus are dependent on the safety circuit, but are not coupled directly thereto but indirectly via an interposed switching unit.

In addition, the sensors can in turn be connected in series. In particular when such decoupling takes place, it is advantageous to identify an interference state of a sensor. In a conventional series circuit, however, only the interruption of the circuit per se can be perceived regularly, but not which sensor is interrupted at that time by a defect. In the case of a large number of sensors, the check in the case of maintenance accordingly requires a corresponding amount of time and therefore also involves corresponding costs. This can be counteracted by virtue of the fact that an indicator apparatus for indicating the switching state of the individual sensors with assignment of the individual switching states to the corresponding sensors is provided. In principle, a corresponding indicator apparatus is capable of indicating which of the sensors has which switching state at that time or which sensor does not have a specific switching state at that time, for example which sensor is open.

In particular, in one development of the invention, the safety device can also be in the form of a bus system, wherein the sensors each have an electronics unit. The sensor is connected to the bus via its corresponding electronics unit. Such a bus enables the transmission and/or interchange of data. For example, data of individual sensors can be read on command. In principle, a bidirectionally operating bus, in which data can be transmitted and received, is conceivable. In principle, however, a unidirectional bus is also conceivable. The data can represent the switching states, but it is also possible for identification data of the sensors to be transmitted which give information regarding which sensor it is. These identification data can also be addresses of the individual sensors, for example. This makes it possible in a particularly elegant manner to read which sensor is indicating a specific state at that time. In addition, bus systems can possibly also operate particularly quickly, which can also make a contribution to increased safety.

In a preferred development of the invention, at least one of the sensors has the following construction: a sensor for safety apparatuses for elevator apparatuses which can move a cab via a drive, wherein the sensor is in the form of an optical sensor which comprises a transmitter for transmitting an optical signal and a receiver for receiving the optical signal. Particularly advantageous in respect of the sensor is the fact that said sensor can operate in contactless fashion, i.e. also without any wear. In addition, the sensor thus does not have any live contact faces, or few contact faces, and is furthermore safe to install. The sensor according to the invention can therefore replace a conventional switch, a so-called interlock switch, from the prior art. In addition, the sensor makes it possible for there to be no need for interruption to the circuit, in contrast to an electromechanical switch.

By virtue of the sensor, it is also possible to avoid a defect which can take place, for example in the case of electromechanical sensors and contacts, by contact erosion as a result of flashover during opening and closing of the electrical contacts and can ultimately result in loss of function.

As a result of the fact that, in the case of the sensor, the circuit does not need to be interrupted, in contrast to a switch, an improved diagnosis in the case of defects is advantageously possible.

As an alternative to the optical sensor, an inductively or capactively operating sensor is also conceivable. In the case of an inductive sensor, a voltage is induced via a coil or an inductance, wherein said voltage in principle depends on the change over time in a magnetic field (duration of the changes, intensity of the changes or distance from the generator of the magnetic field, etc.) and can be measured. In the case of a capacitive sensor, a probe capacitance is measured, wherein the capacitance is dependent, inter alia, on the distance between the capacitor plates or the dielectric between the capacitor plates, i.e. on a material which is fitted between the capacitor plates, for example. A capacitive and inductive sensor also, in the same way as an optical sensor, provides the advantages which are associated with there being no need in principle for any interruption to the circuit.

In addition, a contact link and a contact receptacle for receiving the contact link are provided, which contact link and contact receptacle are arranged in such a way that the closing state of the elevator door can be determined by connection of contact receptacle and contact link. The detection state of the sensor is therefore dependent on the contact link approaching the contact receptacle.

In general, an elevator itself has firstly a cab, which can be moved between individual stories or floors. The individual floors each have shaft openings, with it being possible for the cab to be moved into a holding position in the region of said shaft openings when said cab is intended to approach the corresponding floor. In this holding position, access to the cab is then enabled. This access can be enabled by virtue of the fact that the elevator doors are opened and then closed again and locked prior to continued travel. Elevator doors can be shaft doors or cab doors. The shaft doors are mounted fixedly or moveably in the region of the shaft opening on the shaft itself. In turn, the cab doors are mounted fixedly in moveably on the cab. In each case one cab door is generally associated with a shaft door, wherein the two doors are arranged so as to overlap one another (so as to overlap one another at least partially) in the holding position. Such elevator or cab doors can be supervised, for example, by means of the safety apparatus according to the invention or an embodiment of the invention, in particular by sensors with contact link and contact receptacle.

In order that a journey in the cab can be begun or the cab can continue to travel, it is necessary for all of the doors to be closed and locked. The safety apparatus then checks the locking and possibly interrupts the drive by means of an interrupter apparatus. In principle, the interrupter apparatus or the interruption circuit can address the monitoring unit for this purpose, with the result that said monitoring unit stops the drive via the motor regulation system; it is also conceivable for the interruption apparatus to interrupt the power supply to the drive/motor directly.

The corresponding sensor is thus designed to check whether the corresponding door of an elevator or a shaft is open or closed and locked. In this case it is particularly advantageous to design the sensor to be similar to a plug-type connection, with the result that a contact link can engage in a contact shaft. In addition, this measure enables a mechanically very stable apparatus. In principle, the sensor can be designed in such a way that the contact link is received in the shaft of the contact receptacle with play or in a form-fitting manner.

In addition, the contact link is designed in such a way that it comprises at least one transmission element for transmitting an optical signal. As a result, a so-called failsafe circuit can be achieved in particular in an advantageous manner. Only when the contact link has reached a specific position by corresponding connection to the contact receptacle during closing of the door can a corresponding enable for travel be communicated. In the case of simply a light barrier, this is not the case, in principle: the transmission element can be designed in such a way that the transmission of the optical signal takes place in a specific way, which can only be manipulated with great difficulty and is also not readily realized by accident. If this were to be merely a light barrier, for example, which the door would interrupt on closing, this would mean that the drive would also be enabled, when, for example, a corresponding object, a fly or the like interrupts the light barrier.

Another possibility consists in arranging the transmitter or the receiver at the contact receptacle. The transmission of the light via the transmission element can then only take place via the contact link. By virtue of this formation, a particularly compact design is made possible.

One possibility consists in that the transmission element is designed as a reflective surface, wherein this reflective surface reflects the optical signal or the light and conducts it onto the corresponding receiver only in this way. The reflective surface can be arranged, for example, in a notch in the contact link. However, it is also conceivable for the transmission element to be an optical medium. It is conceivable, for example, for the light refraction to be utilized on transition from the air into this optical medium and for the light beam to thus be directed in a certain direction, with the result that only then is it conducted either on the receiver or precisely not onto the receiver.

In addition, a fiber optic conductor can be provided as optical medium. The optical signal is transmitted when the light from said optical signal is coupled into the fiber optic conductor, propagates through the fiber optic conductor and passes via the fiber optic conductor into the receiver.

It is particularly advantageous to design the transmitter as a light-emitting diode and/or receiver as a photodiodes. These are particularly favorable standard electronic components; as a result, in particular costs can be saved.

Moreover, it is also conceivable for the contact receptacle to comprise transmission elements for transmitting the optical signal, for example reflective surfaces or optical media such as fiber optic conductors. It is conceivable for a subsection of the propagation path of the optical signal from the transmitter to the receiver to take place over a reflective surface or through a fiber optic conductor in the contact receptacle. It is also conceivable for the fiber optic conductor to be shifted in the contact receptacle or in the contact link by virtue of the contact link being received, in such a way that transmission of the light is made possible.

Furthermore, the sensor can comprise an electronics unit for evaluating the receiver, which electronics unit is designed to interpret the evaluation of the receiver to give one of the switching states and/or an electrical signal. This means that the electronics unit is designed to generate an electrical signal or produce an electrical contact. Since, however, the mechanical closing state is detected purely optically, this means that it is not absolutely necessary for a mechanical contact or a mechanical opening state to be produced again in order to obtain an electrical signal. It is conceivable, for example, for the optical signal to switch through the receiver, for example a photodiode, and therefore for a conduction state (in contrast to an interruption) to be achieved. As a result, to a certain extent an interpretation of the switching state of the sensor takes place electronically. However, the electronics unit can also, in addition to this, be designed to enable a connection to further electronics. For example, said electronics unit can also be designed to enable a connection to a bus. By virtue of this formation, in particular the relatively low maintenance susceptibility can be improved once again since mechanical contacts and sensors are substantially avoided. It is also particularly advantageous that it is only necessary for the contact link to enter the contact receptacle as mechanical contact connection.

In order that no parasitic light passes accidentally from the transmitter into the receiver, in addition a separating web for optically separating the transmitter and the receiver can be provided. This once again reduces the possibility, in principle, of faults occurring as a result of incorrect interpretation of the signals.

In addition, a diffuser can moreover also be provided, which scatters parasitic light diffusely. It is also conceivable for the receiver to be adjusted in terms of the intensity of the incident light to a certain threshold value during the detection, with the result that, given a certain amount of parasitic light which may enter the receiver, a corresponding sequence signal is not triggered nevertheless, which sequence signal should only be triggered when light is incident in the receiver via the transmission element.

A connection in which the contact receptacle comprises a shaft and the contact link comprises a tongue-shaped lug, which engages in the shaft on connection of contact link and contact receptacle, can be produced in a particularly robust manner, for example. It is also particularly advantageous here that corresponding coding can be implemented, i.e. the contact link, in the same way as a key, needs to have a particular design in order that it can enter the contact receptacle. This can in particular increase the safety of this apparatus, in particular when the contact receptacle shaft is designed in such a way that it is not possible for a hand to enter.

It is likewise possible in the case of a corresponding sensor for at least two transmission elements to be provided which are arranged one behind the other in the movement direction of the contact link, i.e. the contact link dips correspondingly into the contact receptacle on locking of the door and is initially visible for the optical signal or the optical light beam of one of the transmission elements (namely the first transmission element in the movement direction). As it is pushed further, the next transmission element then becomes visible, while the preceding transmission element is pushed out of the optical path. It is thus possible for a plurality of optical signals to occur with a temporal offset. In addition, it is conceivable for the electronics unit to be designed or for the corresponding signals to be passed onto a further evaluation unit in such a way that, for example, the occurrence of the corresponding signals is determined depending on time. Conclusions can thereby be drawn on the speed of the locking. This also enables a conclusion to be drawn on the operational and maintenance state of the locking device of the doors. In principle, the locking and not the door closure is supervised moreover. Depending on how the corresponding transmission elements are arranged or how many of the transmission elements are arranged, the precision of such a determination can be increased, if appropriate.

In principle, the first safety circuit can also furthermore have electromechanical normally-closed switches. If appropriate, these switches should remain, for example, in an existing elevator system and should not be replaced correspondingly during retrofitting, for example, by optical sensors. Optical sensors can be provided in particular for checking proper locking of elevator doors. If the elevator is intended to be stopped in its movement, however, even when the locking has been performed correctly, but a special interference case is present, electromechanical normally-closed switches can also continue to be used for checking such interference cases, if appropriate.

The sensors and/or normally-closed switches can be connected in series in order that the drive is stopped in the event of an interruption. The circuit therefore corresponds to an AND circuit, i.e. the motor is only running when all of the sensors or normally-closed switches are on and are not interrupting the conduction.

Likewise, a corresponding indicator apparatus can be provided which makes it possible, for example, to identify which of the sensors has a specific switching state at that time and is possibly defective. In one embodiment of the invention, the indicator apparatus can also be connected to the bus.

Furthermore, the sensor can comprise an electronics unit for evaluating the receiver, which electronics unit is designed to interpret the evaluation of the receiver to give one of the switching states and/or an electrical signal. This means that the electronics unit is designed to generate an electrical signal or produce an electrical contact. Since, however, the mechanical closing state is detected purely optically, this means that it is not absolutely necessary for a mechanical contact or a mechanical opening state to be produced again in order to obtain an electrical signal. It is conceivable, for example, for the optical signal to switch through the receiver, for example a photodiode, and therefore for a conduction state (in contrast to an interruption) to be achieved. As a result, to a certain extent an interpretation of the switching state of the sensor takes place electronically. However, the electronics unit can also, in addition to this, be designed to enable a connection to further electronics. For example, said electronics unit can also be designed to enable a connection to a bus. By virtue of this formation, in particular the relatively low maintenance susceptibility can be improved once again since mechanical contacts and sensors are substantially avoided. It is also particularly advantageous that it is only necessary for the contact link to enter the contact receptacle as mechanical contact connection.

In a development of the invention, the electronics unit is for communication with a switching unit, in particular for transmitting switching states and/or identification signals. The switching unit is a component part with which conduction can be opened or closed by a switching operation, in a similar manner to in the case of a relay or contactor. However, the switching operation is triggered when a corresponding signal or a corresponding information item is passed on to the switching unit by the sensors. It is advantageous in particular that the conduction between the switching unit and the sensor no longer needs to be interrupted, as is generally the case for example in the case of a contactor/rely.

The electronics unit can be arranged in particular in or on the contact receptacle, in which the transmitter and receiver are also arranged. The contact receptacle can be arranged for example statically in the elevator apparatus, while the contact link is arranged on a moveable part and merely represents the "key" in order to enable the signal transmission in the contact receptacle.

A sensor can comprise precisely two connections, which are firstly used for power supply and are secondly used for communication with the electronics unit. Therefore, the same line as is also used for power supply is used for communication. This measure enables a particularly compact and cost-effect design. In addition, it is possible, in the case of retrofitting when, for example, a conventional sensor is replaced by a sensor in accordance with the invention, for there to be no need for any additional lines or connections to be laid.

In addition, in the case of a sensor, the communication can take place via modulation of the internal resistance of the sensor. In the circuit with the switching unit, the voltage and/or the current intensity can thus be modulated depending on the circuit. This modulation then carries the information which is intended to be transmitted during the communication. For example, a circuit which comprises sensors connected in series and a switching unit (likewise connected in series) is conceivable. If the resistance of a sensor changes in the case of sensors connected in series, the current intensity changes. If, for example, a constant current source is used for the circuit, a change in the resistance has the effect that the voltage needs to be increased in order to compensate for the resulting decrease in the current intensity, which is initially caused by the lower resistance. The modulation can therefore be an information carrier. The changes in the current intensity or voltage can be measured and can be interpreted as information.

In turn, in one development of the invention, the switching unit is designed to implement the communication with the sensors by modulation of the current intensity or the voltage. This measure can take place by changes in resistance or corresponding changes in or matching of voltage or current intensity.

In a series circuit, it is in particular advantageous when the sensor has a low contact resistance. The resistance of a sensor can be in the range from 1 ohm to 100 ohms, in particular in the range of from 5 ohms to 20 ohms, preferably less than 10 ohms, for example. Precisely in the case of a series circuit, it is advantageous to design the contact resistance to be as low as possible, in particular less than 10 ohms, in order that the voltage drop across the sensor is not excessively high.

Correspondingly, in addition an elevator apparatus according to the invention with a cab and at least one elevator door for opening and/or closing the cab and with a safety apparatus is characterized by the fact that a safety apparatus according to the invention is provided. As a result, inter alia, the already described advantages can be used directly.

It is conceivable in particular for the contact link to be fitted to an elevator door and the contact receptacle to the cab itself. In principle, however, a reverse design is also conceivable, namely: the contact receptacle on the elevator door and the contact link on the cab. Similarly, the contact link and the contact receptacle can also be arranged on the shaft door and on the shaft or shaft frame respectively.

The contact receptacle itself can furthermore have a housing with fitting elements and the above-described insertion slot for the contact link. The electronics unit can be in the form of a printed circuit board (PCB) with a light-emitting diode (LED) and a corresponding photodiode as receiver. The separating web can be arranged correspondingly between the transmitter and the receiver. In addition, it is also conceivable for corresponding contacts, for example for making contact with the photodiodes, to enable a connection to a corresponding electronics unit. The electronics unit can also be provided as a separate component part or integrated in a separate part of the elevator. In principle, the light connection between the transmitter and the receiver can be converted into an electrical signal to a certain extent. In turn, the contact link can have a mounting plate, a corresponding tongue with optical fibers, wherein in this case, the corresponding optical fibers can guide light from the LED to the photodiodes when the tongue is inserted. If appropriate, the corresponding parts can in particular also be prefitted.

A particular advantage of the objects according to the invention consists in that virtually no live contact faces are provided, i.e. fitting can be performed very safely. The evaluation of the speed of the increase in illumination at the photodiodes or the sequence of the light pulses of two light transmission elements makes it possible to draw a conclusion on the speed of the locking of the door in respect of the maintenance state. Therefore, in addition information relating to the maintenance state or the aging of the apparatus can be determined. In addition, evaluation of the ultimate luminance can be performed in connection with the development of the illumination over time. This can in particular enable a conclusion to be drawn on the penetration depth and also on the locking safety. A plurality of transmission elements also enable dynamic detection. In addition, it is conceivable for the robustness to be increased by virtue of the fact that design measures are provided which envisage covering of the LED or the photodiodes. Precisely by virtue of the formation of a contact receptacle in the form of a shaft, this is enabled in a particularly advantageous manner.

As has already been mentioned, a separate evaluation unit can be provided which can communicate with the corresponding bus via an interface, for example. A particular advantage of the apparatus according to the invention consists in that no interruption of an electrical contact is provided, but only a transmission of a signal optically is enabled or prevented.

A further advantage of the invention consists in that the apparatus according to the invention can be retrofitted particularly easily. In an existing elevator system, until now it has been particularly disadvantageous that, in the event of a defect of a sensor, virtually all sensors need to be investigated separately in this regard in the individual stories. In addition, it is possibly no possible to identify whether it is a defect of an individual sensor or a plurality of sensors, with the result that possibly all sensors need to be checked. The states of the sensors, i.e. defective or not or open or not, can be indicated centrally via an evaluation unit conveniently using a computer, a control panel or the like.

In a corresponding retrofitting method, the safety device can be used as a replacement part. The connection to the normally-closed switches, for example conventional electromechanical switches, can be capped. Instead, the switching unit of the safety device is connected. In the case of elevators, the complexity for retrofitting can thus be considerably reduced. It is often sufficient to pull in a relatively long connecting line over the stories. Both lines to the old normally-closed switches can also usually be capped in an uncomplicated manner virtually at a location in the vicinity of the control center.

In connection with the retrofitting, a retrofitting apparatus is installed in a corresponding elevator apparatus to be retrofitted, wherein the elevator apparatus has a safety circuit which, in the context of the invention, corresponds to the first safety circuit and has normally-closed switches. The retrofitting apparatus comprises sensors, which can be switched between at least two switching states depending on the closing state of the elevator door. Furthermore, the retrofitting apparatus comprises a switching unit, which can be used instead of the normally-closed switches to be replaced. The switching unit is switchable by means of the sensors. The sensors and the switching unit can interchange information, for example via modulation of the voltage/current intensity or the internal resistance of the sensors.

BRIEF DESCRIPTION OF THE DRAWINGS

Exemplary embodiments of the invention are illustrated in the drawings and will be explained in more detail below with reference to further details and advantages.

DETAILED DESCRIPTION OF THE INVENTION

Figure 1:
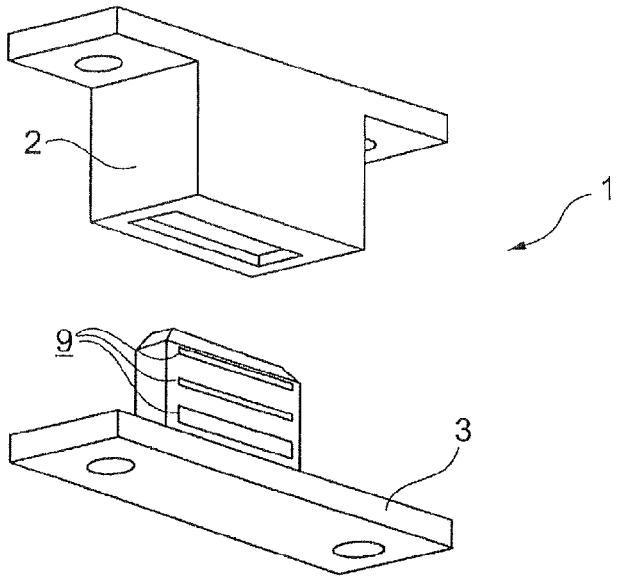
FIG. 1 shows a sensor comprising a contact link with reflective strips and a contact receptacle in accordance with the invention.

FIG. 1 shows a sensor 1 with a contact receptacle (shaft) and a contact link 3, wherein the contact link has reflective strips 9, which reflect light emitted by a transmitter of the contact receptacle 2 in the direction of a receiver of the contact receptacle 2.

Figure 2:
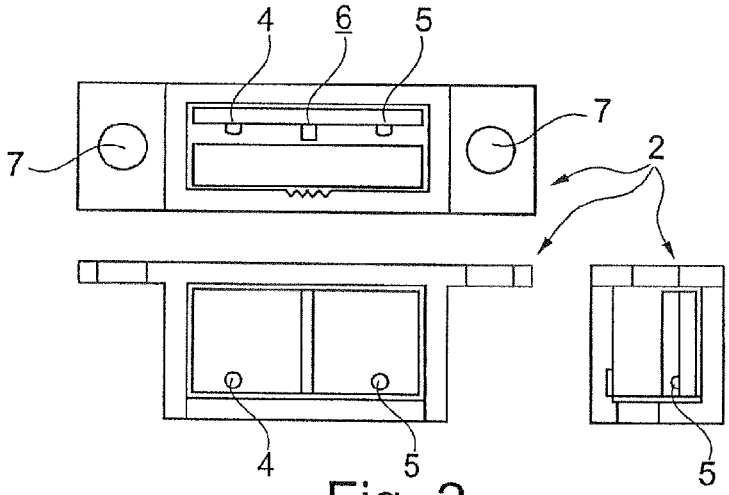
FIG. 2 shows a contact receptacle in accordance with the invention.

FIG. 2 in turn shows the corresponding contact receptacle 2 with a transmitter 4 and a receiver 5, between which a separating web 6 is arranged, to be precise in a front view, a side view and a plan view. The reference symbol 7 denotes fitting apparatuses and fitting aids. The contact link 2 has additional electrical connections, via which the sensor 1 can be connected to the rest of the sensor apparatus and to the safety circuit.

Figure 3:
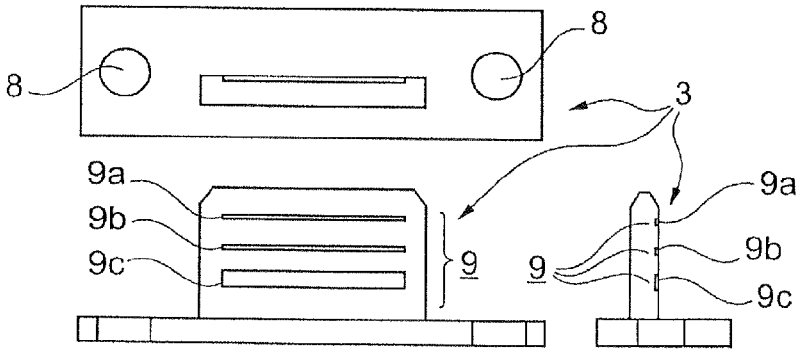
FIG. 3 shows a contact link with reflective strips in accordance with the invention.

FIG. 3 shows a contact link in different views, to be precise in a front view, a side view and a plan view. The contact link also comprises corresponding fitting aids 8. Slots are incorporated in the contact link 3 as transmission elements 9, the slots each having reflective surfaces. In total, there are three reflective units 9*a*, 9*b*, 9*c*, with the result that, to a certain extent, dynamic contact detection is enabled since, when the contact link 3 enters the contact receptacle 2 or the optical light path, first the reflective unit 9*a*, then the reflective unit 9*b* and finally 9*c* enter and therefore a dynamic measurement of the signal with a time dependency is possible.

Figure 4:
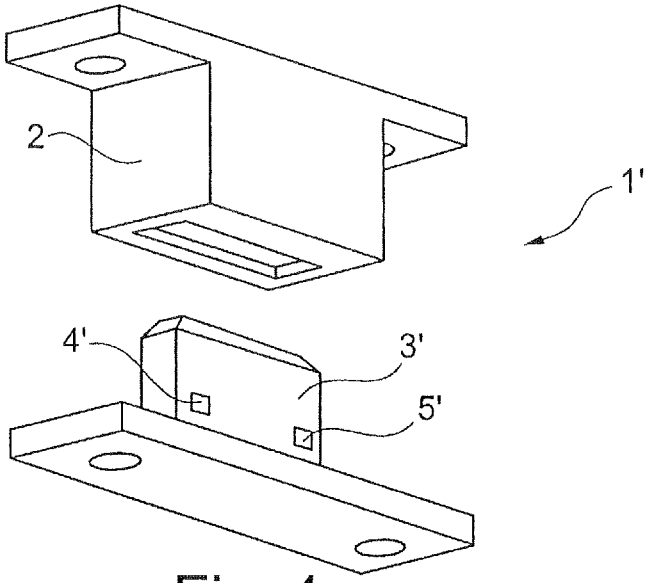
FIG. 4 shows a sensor comprising a contact link with a fiber optic conductor and a contact receptacle in accordance with the invention.

FIG. 4 shows a sensor 1' with a contact receptacle (shaft) and a contact link 3', wherein the contact link has a fiber optic conductor; the light emitted by a transmitter of the contact receptacle 2 passes into the fiber optic conductor input 4', propagates through the fiber optic conductor and emerges from the fiber optic conductor output 5' again, with the result that it passes to the receiver of the contact receptacle 2.

Figure 5:
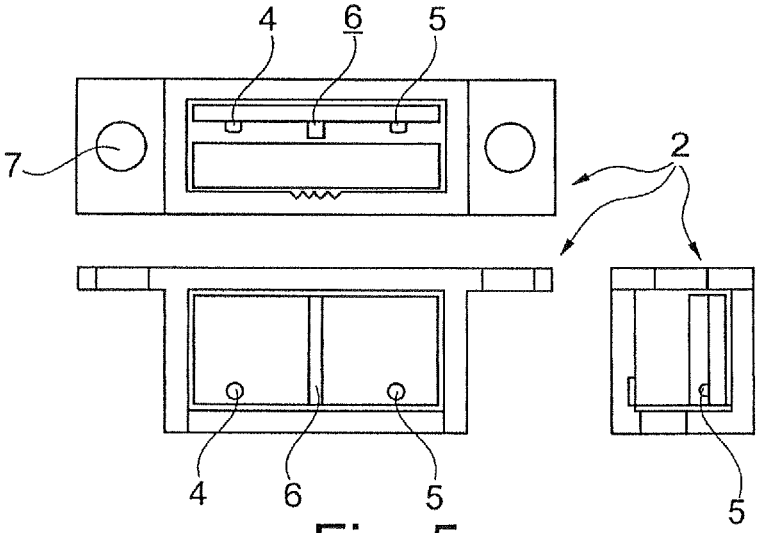
FIG. 5 shows a contact receptacle in accordance with the invention, as in FIG. 2.

In turn, FIG. 5 shows the corresponding contact receptacle 2, as has already been described in relation to FIG. 2, which is also suitable for a sensor 1' with a fiber optic conductor.

Figure 6:
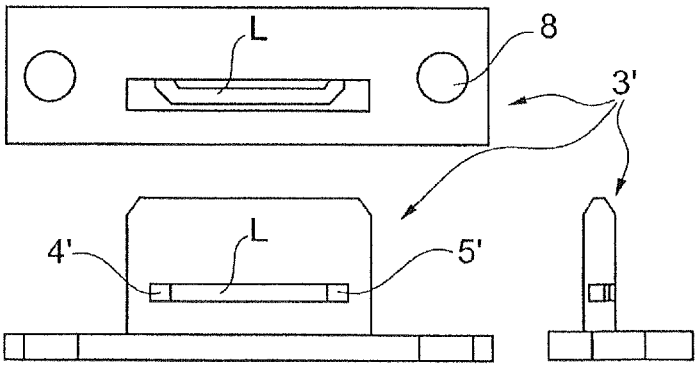
FIG. 6 shows a contact link having a fiber optic conductor in accordance with the invention.

FIG. 6 shows a contact link 3' in various views, to be precise in a front view, a side view and a plan view. This contact link also comprises corresponding fitting aids 8. A fiber optic conductor is incorporated as transmission element L into the contact link 3' and the light signal emitted by the contact receptacle can propagate through the said fiber optic conductor. Also shown are the light inlet 4' and the light outlet 5'.

Figure 7:
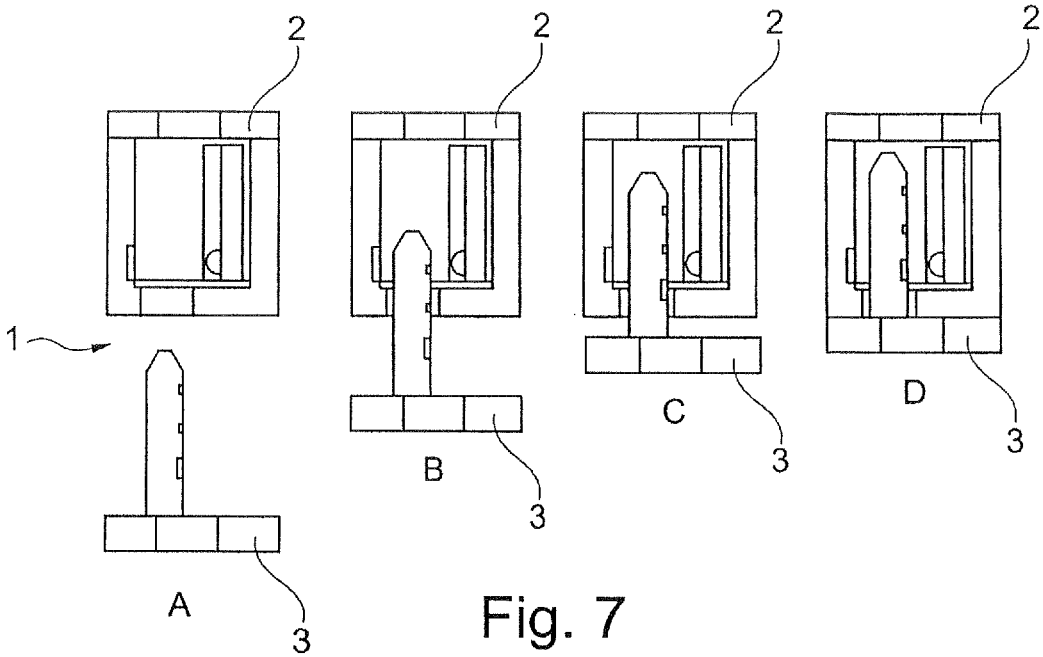
FIG. 7 shows the connection (time sequence) of the contact link and the contact receptacle in accordance with the invention.

FIG. 7 shows such a process for the contact link 3 (with respective strips) entering the contact receptacle 2, wherein in situation A, the contact link is not yet connected to the contact receptacle 2. In situation B, the reflective unit 9*a* has passed precisely in the region of the optical path and transmits the light path from the transmitter to the receiver. In situation C, the contact link 3 is positioned precisely in such a way that interruption of the optical signal takes place since the contact link 3, in terms of its height is positioned precisely between the reflective units 9*b* and 9*c* and the optical path is therefore interrupted. Only in situation D is the contact link, fully inserted into the contact receptacle 2, in such a position that the optical path is not interrupted and light can pass from the receiver 4 via the reflective element 9*c* into the detector/the photodiodes. The reflective units 9*b* and also other transmission units such as optical media can have different forms and provide characteristic reflections or light transmissions, with the result that they can each be identified by means of the receiver or the electronics unit as well, if appropriate.

Figure 8:
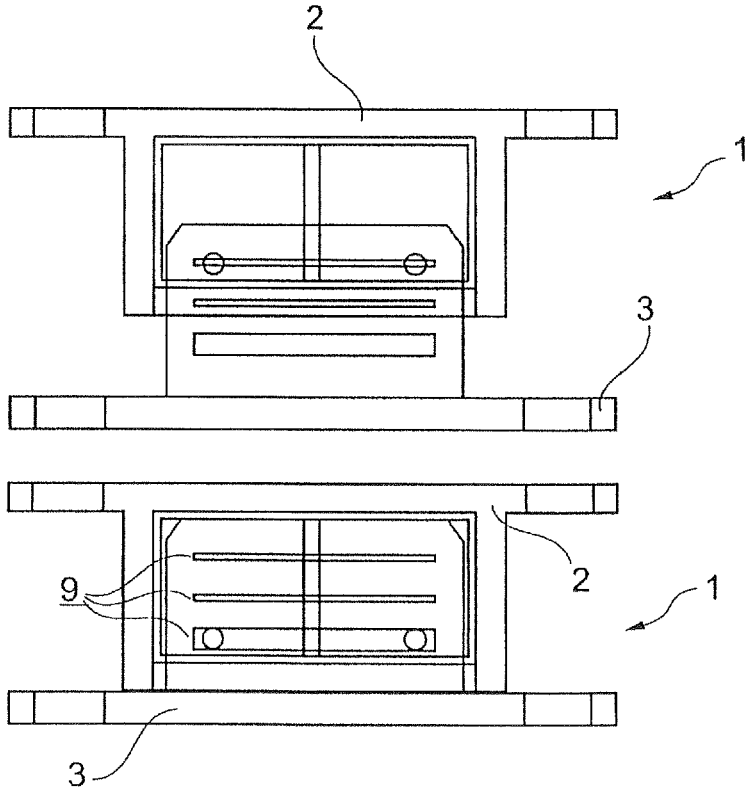
FIG. 8 shows a sensor with reflective strips in accordance with the invention.

FIG. 8 shows a similar illustration, in which the contact link 3 enters the contact receptacle 2.

Figure 9:
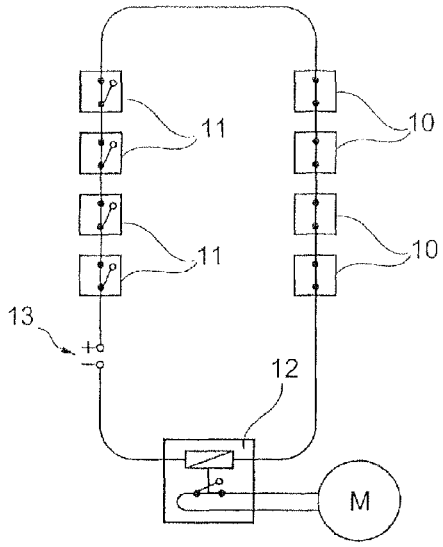
FIG. 9 shows a safety apparatus with sensors.

In turn, FIG. 9 shows a safety apparatus with a plurality of optical sensors 10, which are all connected in series. Furthermore, a series of further electromechanical normally-closed switches 11 is provided which can be used otherwise in connection with an elevator. In addition a voltage source 13 is provided. All of these switches or sensors 11 and 10 are connected in series and are connected to a switching unit 12. This circuit comprising a series circuit of the switches 11, the sensors 10 and the switching unit 12 forms a safety circuit. If one of the switches 11 is interrupted, the entire circuit is interrupted, and the switching unit 12 disconnects the motor M, which represents the drive for the elevator cab. The switches 11 can be normally-closed switches of a known type. If one of the sensors 10 detects that, for example, the elevator is not locked properly, the sensor transmits a corresponding signal via the circuit, and this signal is received by the communication unit of the switching unit 12, with the result that it can disconnect the motor M. Correspondingly, the switching unit 12 sometimes performs the function of a relay; in addition, switching operations of the switching unit are also dependent on signals of the sensors, however. The switching unit 12 therefore does not respond to line interruptions.

Figure 10:
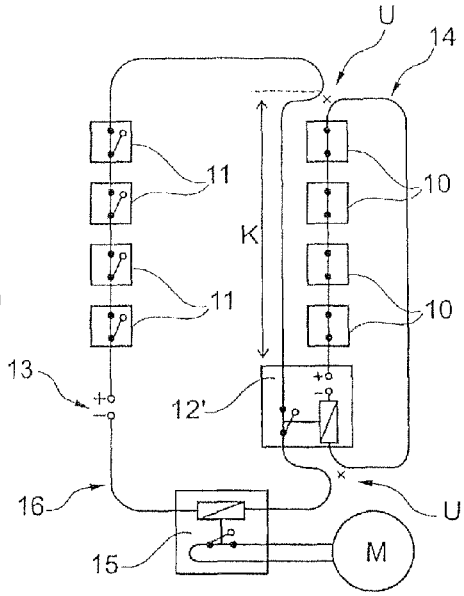
FIG. 10 shows a safety apparatus with safety circuit.

FIG. 10 shows a safety apparatus with a safety device, namely a (second) safety circuit 14, with corresponding optical sensors 10. This safety circuit is connected to the first safety circuit 16 via a switching unit 12', said first safety circuit in turn having further sensors 11. The switching unit 12' is similar to the switching unit 12 and has the same mode of operation; in this case, in contrast to the switching unit 12 shown in FIG. 9, however, the voltage source is integrated in the switching unit 12' as well. A contactor/relay 15, which can in turn disconnect a drive M, is located in the first safety circuit 16. The contactor 15 is merely designed to disconnect the motor M in the event of a line interruption in the circuit 16. If one of the sensors 10 is optically interrupted, the switching unit 12' is also interrupted and therefore the line of the first safety circuit 16. The contactor 15 disconnects the motor M. Instead of the conventional normally-closed switches, the sensors according to the invention are combined in a dedicated safety circuit 14 and are connected to the original, first safety circuit 16 via the switching unit 12'. The safety circuit 16 can in this case sometimes use the wiring of the original safety apparatus.

FIG. 10 also illustrates how a conventional apparatus can be retrofitted by virtue of the original first safety circuit 16 being capped at the points U and the second safety circuit 14 with the switching unit 12' being used correspondingly. It is then only necessary for a relatively long cable K to be pulled in. The communication device for communicating with the monitoring unit is in this case not illustrated.

Figure 11:
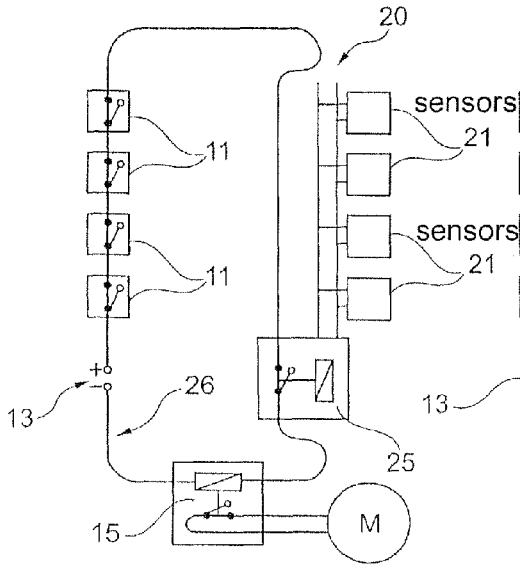
FIG. 11 shows a safety apparatus with bus.

FIG. 11 shows a corresponding apparatus, in which a bus 20 is arranged as safety device instead of a second safety circuit. The corresponding sensors 21 have an electronics unit, which enables a connection to the corresponding bus 20. The bus is likewise connected to a switching unit 25, with the result that, in the event of an interruption of one of the optical sensors 21, said sensor in turn transmits a signal to the switching unit 25 which in turn interrupts the first safety circuit 26. Owing to the interrupted line in the safety circuit 26, the motor M is disconnected via the contactor 15. The switching unit 25 can form, for example, the master in the bus, while the sensors 21 are present in a slave configuration.

Figure 12:
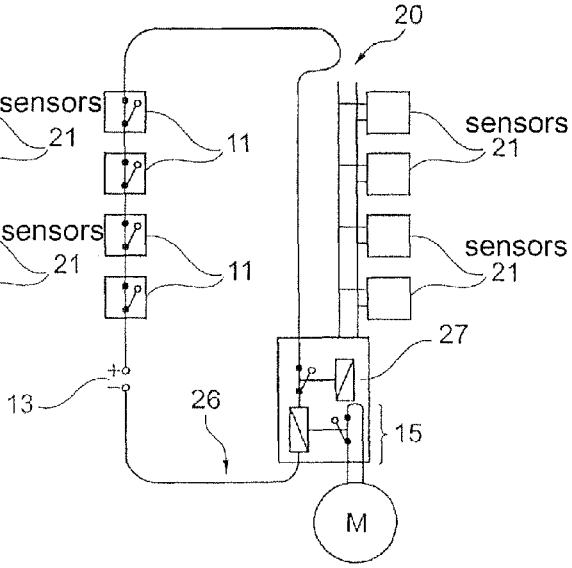
FIG. 12 shows a safety apparatus with bus and an integrated contactor in the switching unit.

FIG. 12 shows a similar apparatus to that shown in FIG. 11, but in this case the contactor 15 is integrated additionally in the switching unit 27, wherein the contactor disconnects the motor, if appropriate.

Figure 13:
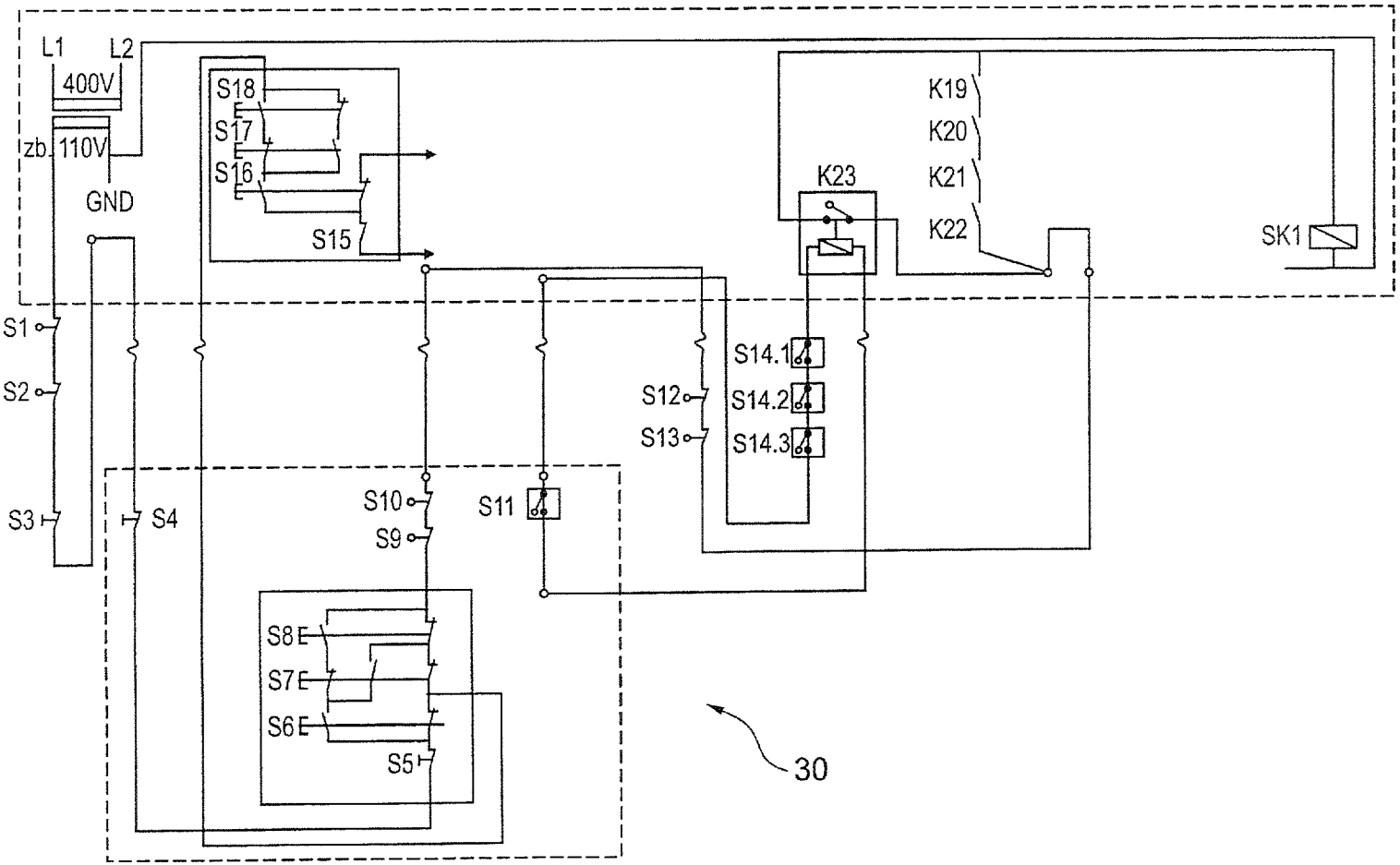
FIG. 13 shows a circuit diagram for an elevator in accordance with the invention.

FIG. 13 shows an exemplary circuit diagram 30 of an elevator in accordance with the invention.

Figure 14:
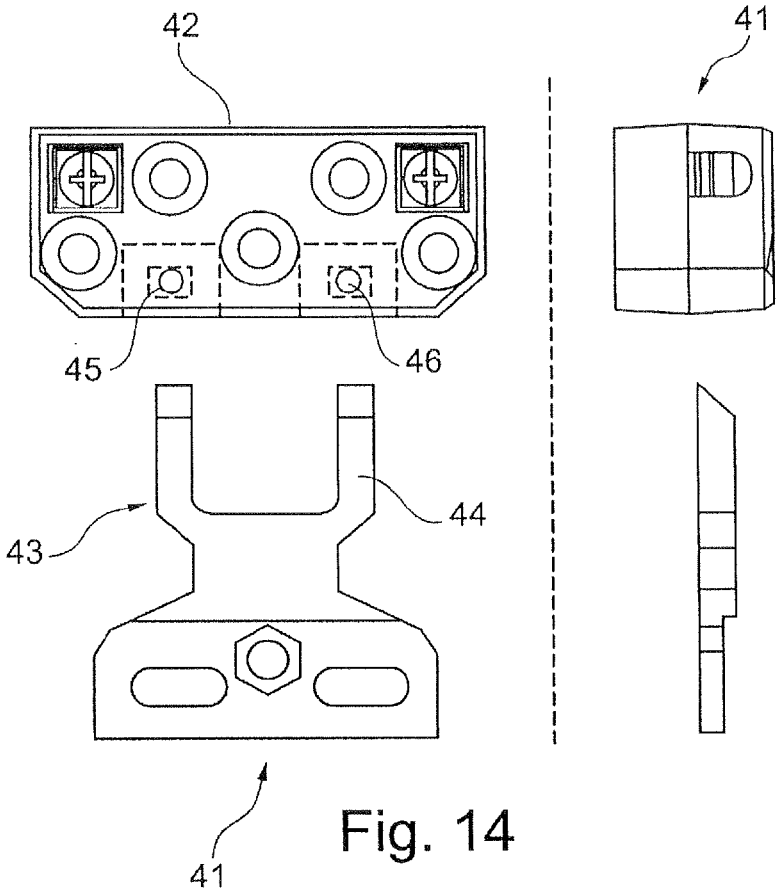
FIG. 14 shows a sensor with fiber optic conductors in accordance with the invention.
Figure 15:
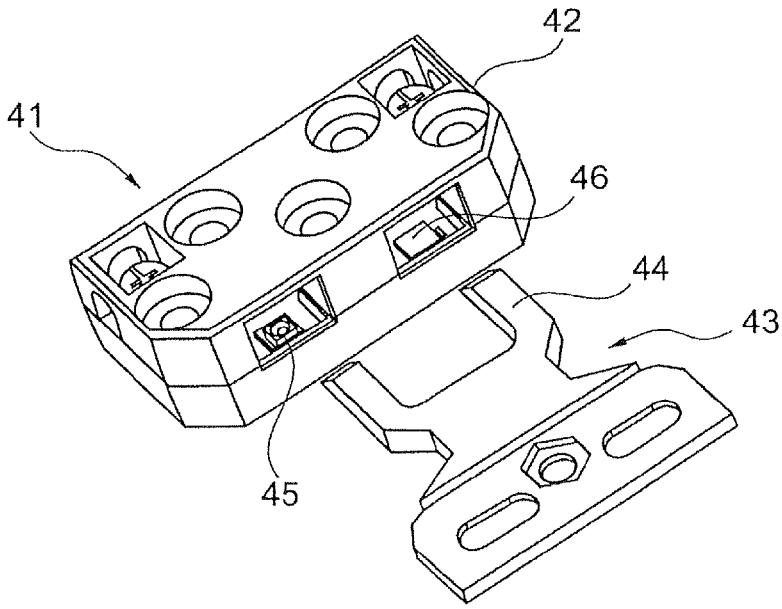
FIG. 15 shows a perspective view of the sensor shown in FIG. 14.

FIG. 14 shows a sensor 41 in plan view and in a side view with a contact receptacle 42 and a contact link 43, in which a fiber optic conductor 44 is arranged. In this case, the contact link 43 is overall in the form of a fiber optic conductor 44, i.e. comprises the corresponding optical medium. The contact receptacle 42 comprises a transmitter 45 and a receiver 46 for transmitting/receiving optical signals. The optical signal emitted by the transmitter 45 can propagate through the fiber optic conductor 44 as soon as the contact receptacle 42 has received the contact link 43 and thus passes into the receiver 46. The contact link 43 (or the fiber optic conductor 44) is in the form of a U and, when it is plugged into the contact receptacle 42, engages only with the two limbs into the two shafts of the contact receptacle 42. Correspondingly, the fiber optic conductor 44 is likewise in the form of a U. In turn, FIG. 15 shows the sensor 41 in a perspective view.

Figure 16:
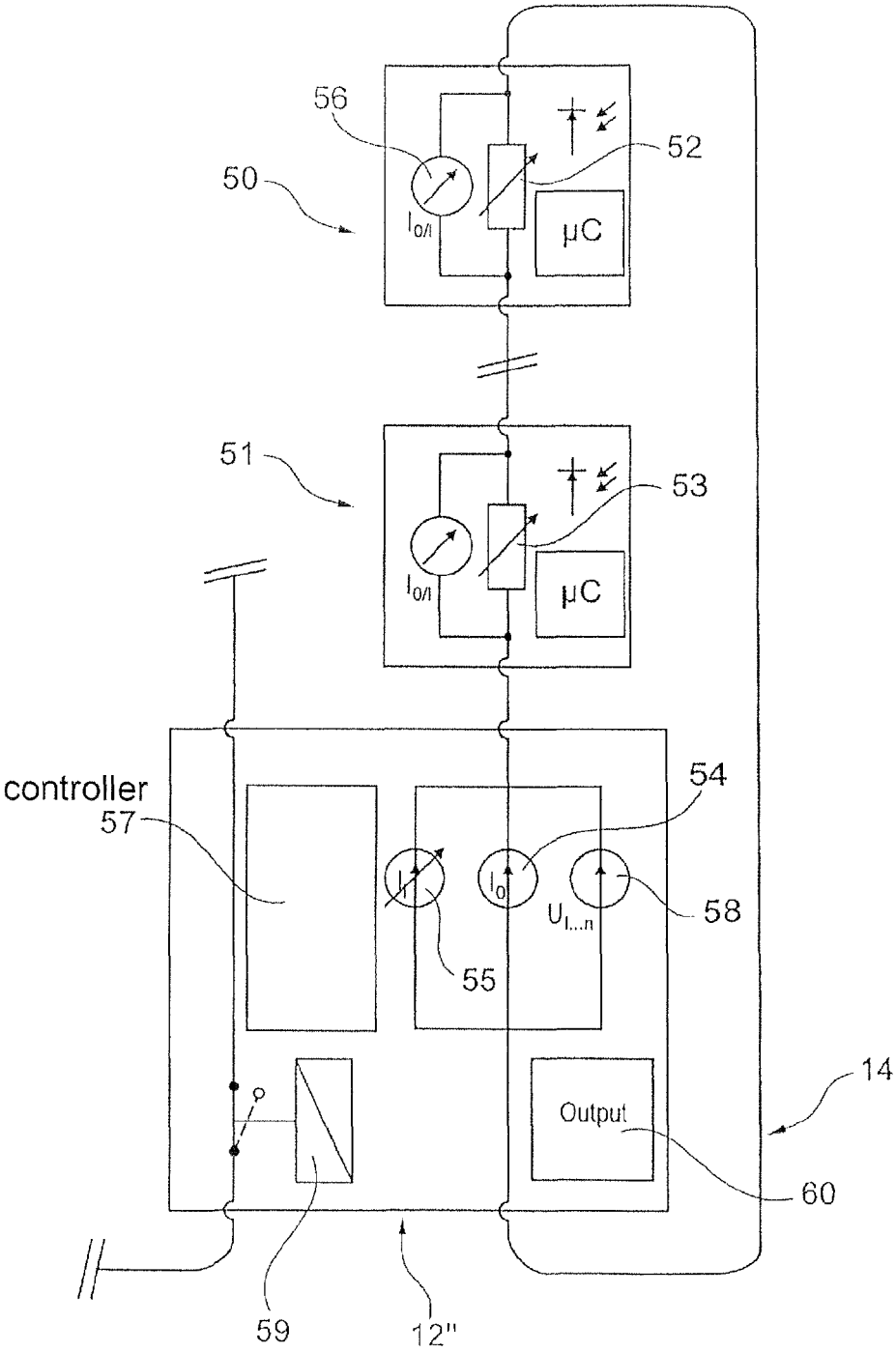
FIG. 16 shows a schematic illustration illustrating how the communication with individual sensors takes place in a safety apparatus in accordance with the invention.

FIG. 16 shows a schematic illustration of the communication in the safety circuit 14 between the controller 57 of the switching unit and the individual sensors 10 or microcontrollers μC thereof. The communication between the controller 57 and the individual sensors takes place via current modulation, while, conversely from the sensor 10 to the controller 57, voltage modulation takes place.

It is generally necessary for marked changes in or modulations of current or voltage to take place since, owing to the large cable lengths arising in the elevator system, the change would otherwise be unnoticeable. For example, current changes in the region of a factor 3 are conceivable.

The units 50, 51 each correspond to a sensor. The reference symbols 52, 53 represent variable resistors. A variable resistor is assigned to each sensor. The change in the resistance can take place in various ways: it is conceivable for resistors to be added to a circuit of other resistors in parallel, as a result of which the total resistance is correspondingly reduced. However, it is also conceivable for the resistance to be influenced using circuitry, for example by blocking individual transistors. The change in the resistance can be influenced optically, for example, by phototransistors, photodiodes, optocouplers or the like.

The circuit comprises constant current sources 54, 55, which are each designed to match their voltage in the case of a variable resistor in the circuit in such a way that a constant current flows. A change in the resistance (communication: controller 57 at sensor 10) regulates the constant current source 54 to a constant current intensity, with the result that the voltage measured across the voltmeter 56 changes.

If a further constant current source 55 is added to the circuit, the current intensity can also be modulated, i.e. the voltage does not remain constant (communication: sensor at controller). The change in the voltage applied to the circuit can be determined by the voltmeter 58.

Thus, the states of the individual sensors or other data of the sensors can be output via an output 60. The relay 59 is controlled corresponding to the sensors via the microcontroller 57.

FIG. 16 illustrates a switching unit 12" as is illustrated for example in FIG. 9 as a switching unit 12 or in FIG. 10 as switching unit 12'. The switching unit 12' also comprises a voltage source. The switching unit 12 shown in FIG. 9 comprises in particular also the function of a relay which can also disconnect the motor M in the event of a line interruption. The switching unit 12 is connected to a (second) safety circuit 14 in FIG. 16.

Figure 17:
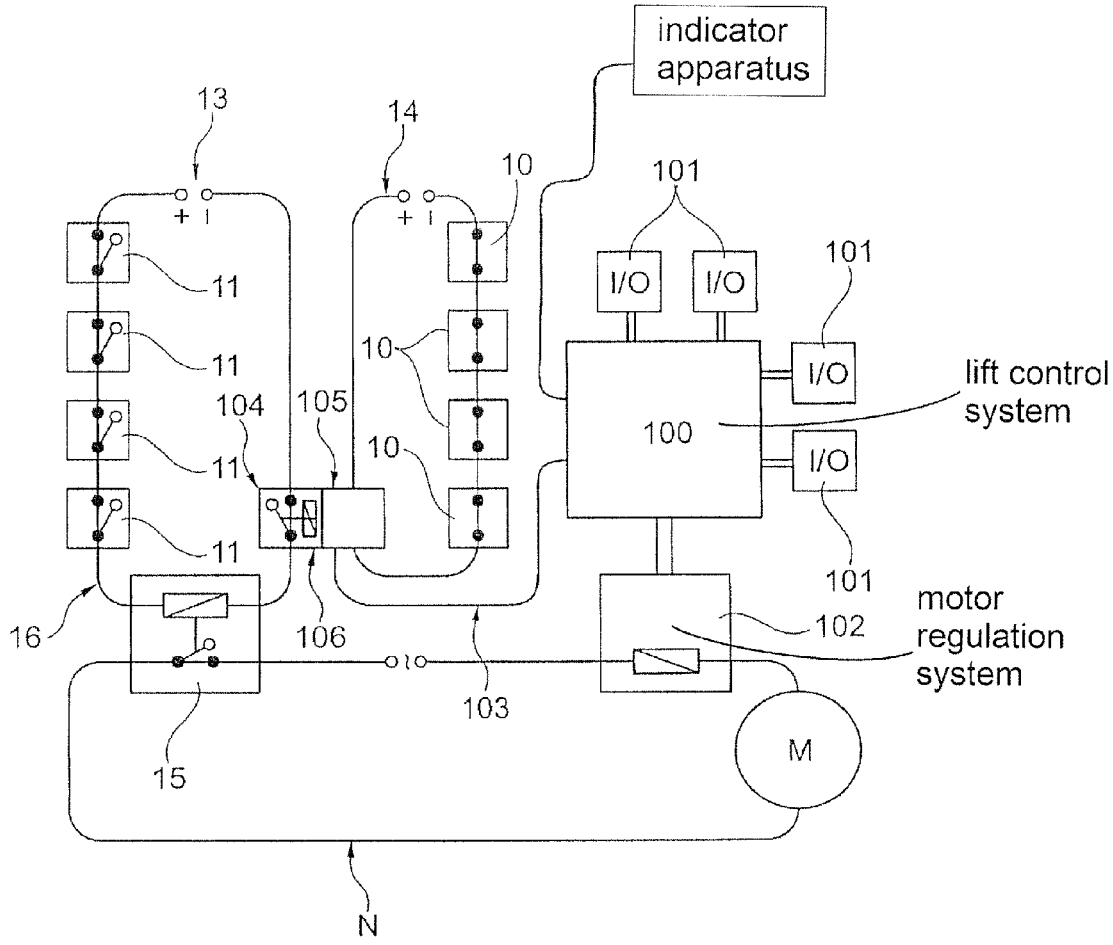
FIG. 17 shows a drive apparatus with a safety apparatus in accordance with the invention.

Correspondingly, FIG. 17 shows a complete drive apparatus in accordance with the invention. The drive apparatus comprises a drive circuit N, via which the motor M is operated for driving the cab. The safety apparatus substantially corresponds to that shown in FIG. 10. The switching unit 12' shown in FIG. 10 is illustrated schematically in FIG. 17 as switching unit 106, which comprises an interruption apparatus 104 and a communication apparatus or a controller 105 for data interchange with the monitoring unit or lift control system 100 via a data line 103. The lift control system 100 can also communicate with other appliances of the elevator via input/output (I/O) interfaces 101. In addition, the lift control system 100 is connected to the motor regulation system 102, which in turn is connected into the drive circuit N for controlling the motor M. The lift control system 100 transmits data to a display apparatus (not illustrated in any further detail) or to the monitoring center for the elevator, inter alia also the data relating to the status of the safety apparatus, via an I/O interface. Furthermore, the lift control system 100 can, in the event of a fault or for example a blockage of the elevator door, not only allow this status to be indicated but also drive the motor regulation system 102 correspondingly with respect to the interruption to the drive circuit N.

LIST OF REFERENCE SYMBOLS

1 Sensor
1' Sensor
2 Contact receptacle
3 Contact link
3' Contact link
4 Transmitter
4' Fiber optic conductor input
5 Receiver
5' Fiber optic conductor output
6 Separating web
7 Fitting unit
8 Fitting unit
9 Reflective surface
**9*a*** Reflective surface
**9*b*** Reflective surface
**9*c*** Reflective surface
10 Optical sensor
11 Electromechanical normally-closed switch
12 Switching unit
12' Switching unit (with voltage source)
12" Switching unit
13 Voltage source
14 Second safety circuit
15 Contactor/relay
16 First safety circuit
20 Bus
21 Optical sensor with electronics unit
25 Switching unit
26 Safety circuit
27 Switching unit with integrated contactor
30 Circuit diagram
41 Sensor
42 Contact receptacle
43 Contact link
44 Fiber optic conductor
45 Transmitter
46 Receiver
50 Communication unit

51 Communication unit
52 Variable resistor
53 Variable resistor
54 Constant current source
55 Constant current source
56 Voltmeter
57 Microcontroller of switching unit
58 Voltmeter
59 Relay
60 Output
100 Lift control system/monitoring unit
101 Input/output interface
102 Motor regulation system
103 Communication link
104 Contactor of switching unit
105 Transmission apparatus/controller
106 Switching unit
A View at first point in time
B View at second point in time
C View at third point in time
D View at fourth point in time
K Cable/electrical line
L Fiber optic conductor
M Drive motor
N Drive circuit
μC Microcontroller of a sensor
U Interruption

We claim:

1. A safety apparatus for an elevator apparatus which can move a cab via a drive, comprising:

a monitoring unit for monitoring the drive based on at least one of data and monitoring signals;

a first safety circuit, which has a closed conduction state and an open conduction state, with an interruption apparatus for interrupting the drive depending on the conduction state of the first safety circuit;

a safety device comprising at least two sensors that are switched between at least two switching states depending on a closing state of an elevator door of the elevator apparatus to be detected by the sensors; and a switching unit that is switched between at least two switching states by connection to the safety device to effect one of the closed and open conduction states of the first safety circuit, wherein the switching unit comprises a transmission device for transmitting at least one of the data and the monitoring signals to the monitoring unit, and wherein the transmission device is a controller that has a connection to the safety device, and the transmission device operates to switch the switching unit.

2. The safety apparatus according to claim 1, wherein the transmission device receives at least one of data and monitoring signals from the monitoring unit.

3. The safety apparatus according to claim 1, wherein the safety device is a second safety circuit.

4. The safety apparatus according to claim 1, wherein the safety device is in the form of a bus system, wherein the sensors each have an electronics unit that is connected to the bus, such that at least one of the switching states of the sensors and identification data from the sensors is communicated via the bus.

5. The safety apparatus according to claim 1, wherein at least one of the sensors comprises a contact link and a contact receptacle for receiving the contact link, which contact link and contact receptacle are arranged such that the closing state can be determined by connection of the contact receptacle and contact link, wherein the sensor is in the form of an optical sensor comprising a transmitter for transmitting an optical signal and a receiver for receiving the optical signal, wherein the transmitter and the receiver are arranged on the contact receptacle and the contact link comprises at least one transmission element for transmitting the optical signal.

6. The safety apparatus according to claim 1, wherein at least one of the sensors is in the form of an inductive or capacitive sensor.

7. The safety apparatus according to claim 1, wherein the first safety circuit comprises at least one electromechanical switch.

8. The safety apparatus according to claim 1, wherein at least two of the sensors are connected in series.

9. The safety apparatus according to claim 1, further comprising an indicator apparatus for indicating the switching state of the individual sensors with assignment of the individual switching states to the corresponding sensors.

10. The safety apparatus according to claim 4, further comprising an indicator apparatus that is connected to the bus and indicates using the switching states and identification data, at least one of which sensors have which switching state and which sensor has a specific switching state.

11. The safety apparatus according to claim 1, wherein the switching unit implements communication with the sensors by modulation of the current intensity and the voltage.

12. The safety apparatus according to claim 1, wherein the sensor implements modulation of the internal resistance of said sensor for communication with the switching unit.

13. An elevator apparatus comprising a cab and at least one elevator door for opening and closing the cab, a monitoring unit for monitoring the drive, and a safety apparatus according to claim 1 for checking the locking of the elevator door during operation.

14. The elevator apparatus according to claim 13, wherein at least one of the sensors comprises a contact link and a contact receptacle for receiving the contact link, which contact link and contact receptacle are arranged such that the closing state can be determined by connection of the contact receptacle and contact link, wherein the contact link is fitted to at least one of the elevator doors and the contact receptacle is fitted to the cab, or the contact receptacle is fitted to at least one of the elevator doors and the contact link is fitted to the cab.

* * * * *